US007096840B2

(12) United States Patent
Asada et al.

(10) Patent No.: US 7,096,840 B2
(45) Date of Patent: Aug. 29, 2006

(54) STARTING METHOD AND STARTING DEVICE OF INTERNAL COMBUSTION ENGINE, METHOD AND DEVICE OF ESTIMATING STARTING ENERGY EMPLOYED FOR STARTING METHOD AND STARTING DEVICE

(75) Inventors: Toshiaki Asada, Mishima (JP); Shinichi Mitani, Susono (JP); Kimitoshi Tsuji, Susono (JP); Yasushi Kusaka, Susono (JP); Kenji Kataoka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/652,484

(22) Filed: Sep. 2, 2003

(65) Prior Publication Data

US 2004/0055553 A1 Mar. 25, 2004

(30) Foreign Application Priority Data

Sep. 20, 2002 (JP) ..... 2002-275622

(51) Int. Cl.
*F02M 1/00* (2006.01)

(52) U.S. Cl. ..... 123/179.3

(58) Field of Classification Search ..... 123/179.5, 123/179.4, 179.3, 179.1
See application file for complete search history.

(56) References Cited

U.S. PATENT DOCUMENTS 4,009,695 A * 3/1977 Ule ..... 123/179.5
4,364,343 A * 12/1982 Malik ..... 123/179.5
4,462,348 A * 7/1984 Giardini ..... 123/179.1
5,495,127 A 2/1996 Aota et al.
6,050,232 A 4/2000 Grob et al.
6,098,585 A * 8/2000 Brehob et al. ..... 123/179.5
6,125,808 A * 10/2000 Timewell ..... 123/179.5
6,334,417 B1 * 1/2002 Salber et al. ..... 123/179.5
6,357,409 B1 * 3/2002 Haghgooie et al. ..... 123/179.3
6,418,899 B1 * 7/2002 Bluemel et al. ..... 123/179.4

FOREIGN PATENT DOCUMENTS

| | | |
|---|---|---|
| DE | 3117144 | * 11/1982 |
| JP | 11-125136 | 5/1999 |
| JP | 2000-205003 | 7/2000 |
| JP | A 2002-4929 | 1/2002 |
| JP | A 2002-4985 | 1/2002 |
| JP | 2002-89417 | 3/2002 |

* cited by examiner

*Primary Examiner*—Henry C. Yuen
*Assistant Examiner*—Arnold Castro
(74) *Attorney, Agent, or Firm*—Oliff & Berridge, PLC

(57) ABSTRACT

In a method of starting an internal combustion engine, a combustion energy is generated by combusting a fuel that has been injected into a cylinder in an expansion stroke when the internal combustion engine is stopped. In the aforementioned method, the combustion energy generated by combusting the fuel is obtained based on a state of an air/fuel mixture within the cylinder to which the fuel has been injected. Based on the obtained combustion energy, a kinetic energy to be supplied to the internal combustion engine from a primary energy supply source is estimated. A difference between a predetermined target kinetic energy required for starting the internal combustion engine subsequent to the start of combustion and the estimated kinetic energy to be supplied from the primary energy supply source is obtained. The kinetic energy corresponding to the obtained difference is supplied from a secondary energy supply source in the form of a starter motor.

18 Claims, 4 Drawing Sheets

STARTING METHOD AND STARTING DEVICE OF INTERNAL COMBUSTION ENGINE, METHOD AND DEVICE OF ESTIMATING STARTING ENERGY EMPLOYED FOR STARTING METHOD AND STARTING DEVICE

INCORPORATION BY REFERENCE

The disclosure of Japanese Patent Application No.2002-275622 filed on Sep. 20, 2002, including the specification, drawings and abstract are incorporated herein by reference in its entirety.

BACKGROUND OF THE INVENTION

1. Field of Invention

The invention relates to a method and a device of starting an internal combustion engine.

2. Description of Related Art

There is proposed a method of starting an internal combustion engine of direct injection type where fuel is directly injected into cylinders using energy generated by combustion within the cylinder in expansion stroke upon start of the engine in JP-A-2002-4985 (Related Art No. 1). In the disclosed method, success or failure in starting the engine is estimated on the basis of the engine speed after starting the combustion. If failure in starting the engine is estimated, the starter motor is activated so as to compensate for the energy required for starting the engine. Likewise JP-A-2000-4929 (Related art No. 2) discloses the technology in which the fuel is injected into the cylinder in the expansion stroke when an engine operation is stopped, and ignition is performed after sufficient vaporization of the fuel followed by the passage of a preset delay time. The list of the related art of the invention is described as below:

| | |
|---|---|
| Related art No. 1: | JP-A-2002-4985; |
| Related art No. 2: | JP-A-2000-4929; |
| Related art No. 3: | JP-A-11-159374; and |
| Related art No. 4: | JP-A-7-119594. |

In the aforementioned cases, sufficiency of the energy for starting the engine cannot be preliminarily estimated but determined on the basis of success/failure in starting the engine after performing combustion in the cylinder. The required energy to be compensated by the starter motor activated upon failure of starting the engine cannot be preliminarily controlled as well. Therefore, it is difficult for the aforementioned cases to estimate the kinetic energy required for starting the engine preliminarily before performing the combustion. It is likely to cause insufficiency/excess of the kinetic energy supplied by the combustion or the starter motor with respect to the required kinetic energy for starting the engine. This may result in the start-up failure or over-speed of the internal combustion engine.

SUMMARY OF THE INVENTION

It is an object of the invention to provide a method and a system of starting an internal combustion engine reliably by supplying appropriate amount of energy for starting the engine while avoiding unnecessary energy consumption. It is another object of the invention to provide a method and a system of estimating the energy for starting the engine, which are adapted to the aforementioned method and system of starting the engine.

A method of starting an internal combustion engine includes steps of setting a target kinetic energy as being a kinetic energy required for starting the internal combustion engine, and supplying a starting energy controlled in accordance with the target kinetic energy to the internal combustion engine from a predetermined starting energy supply source.

According to the embodiment, the target kinetic energy is preliminarily set and supplied from the starting energy supply source. This makes it possible to reliably start the internal combustion engine by supplying appropriate amount of kinetic energy required for starting the engine while avoiding unnecessary kinetic energy consumption. As a result, the over-speed of the engine upon its start can be prevented, avoiding various problems such as deterioration in the fuel efficiency or noise owing to the over-speed.

In the aforementioned method, the starting energy supply source includes a primary energy supply source and a secondary energy supply source. A difference between the target kinetic energy and a kinetic energy supplied from the primary energy supply source is obtained, and a kinetic energy corresponding to the obtained difference is further supplied from the secondary energy supply source. In this case, most of the required energy for starting the engine is supplied from the primary energy supply source, and the rest of the energy is supplied from the secondary energy supply source. As an amount of the energy supplied from the secondary energy supply source may be small enough to compensate for the shortage of the required energy. This makes it possible to allow the system of starting the engine to be compact and light weight. The restriction of mounting the system may be loosened, resulting in cost reduction.

The primary and the secondary energy supply sources may be structured in arbitrary forms. However, it is preferable to realize the primary energy supply source by causing combustion in the cylinder of the internal combustion engine for supplying the kinetic energy.

A combustion energy generated by the combustion within the cylinder is obtained based on a physical value representing a state of an air/fuel mixture within the cylinder of the internal combustion engine. The kinetic energy to be supplied from the primary energy supply source is estimated based on the obtained combustion energy. The combustion energy generated in the internal combustion engine is obtained using an equation of state of an air/fuel mixture. If the combustion energy in the internal combustion engine is preliminarily obtained, the behavior of the energy therein can be dynamically analyzed because the mechanical structure of the internal combustion engine is already known. This allows an estimation of the kinetic energy supplied to the engine using a dynamic calculation based on the analyzed behavior in the engine. The aforementioned estimation of the kinetic energy supplied to the internal combustion engine may be accurately controlled to the target kinetic energy. The kinetic energy to be supplied from the primary energy supply source is estimated by subtracting an energy consumed by a mechanical loss owing to an operation of the internal combustion engine from the combustion energy. The mechanical loss owing to, for example, friction can be identified in accordance with the mechanical structure or the behavior in the internal combustion engine.

In order to use the kinetic energy generated by the combustion, a cylinder in an expansion stroke is identified when the internal combustion engine is stopped based on a state of the internal combustion engine that is stopped. The combustion is to be started within each cylinder of the internal combustion engine one after another from the identified cylinder. The combustion sequentially occurs in the respective cylinders, first from the cylinder in the expansion stroke in order of ignition in the internal combustion engine. Accordingly the kinetic energy generated by the combustion is supplied to the internal combustion engine while being further supplied with the kinetic energy from the secondary energy supply source. As a result, the internal combustion engine is smoothly brought into a complete combustion state.

In the method of the invention, a cylinder in an expansion stroke is identified when the internal combustion engine is stopped based on a state of the stopped internal combustion engine. Then fuel is injected into the identified cylinder during a period when the internal combustion engine is stopped. It is preferable to change a value of the obtained combustion energy in consideration with a diffusion state of the air/fuel mixture from the injection of the fuel to a start of the combustion within the identified cylinder. The air/fuel mixture of the fuel injected when the engine operation is stopped gradually diffuses from the combustion chamber as a passage of time. Further the air/fuel mixture diffuses, the less the combustion energy becomes. The combustion energy may be more accurately obtained in consideration with the diffusion of the fuel from the fuel injection to the start of combustion. The fuel diffusion state may be defined by the passage of time from the fuel injection.

In the method of the invention, an electric motor may be used as the secondary energy supply source. The use of the electric motor makes it possible to easily control the energy.

A system of starting an internal combustion engine includes a starting energy supply source that supplies a kinetic energy required for starting the internal combustion engine, and a controller that controls the kinetic energy to be supplied to the internal combustion engine from the starting energy supply source in accordance with a predetermined target kinetic energy required for starting the internal combustion engine.

The energy supplied by the starting energy supply source is controlled to the target kinetic energy. This makes it possible to supply appropriate amount of the kinetic energy to the internal combustion engine to be reliably started in the same manner as being in accordance with the aforementioned method. Accordingly the unnecessary energy supply and the over-speed of the internal combustion engine upon starting is prevented, avoiding various problems such as deterioration in the fuel efficiency or noise owing to the over-speed.

The starting system of the internal combustion engine according to the invention is embodied into the following forms to realize the aforementioned starting method.

In the system of the invention, the starting energy supply source may include a primary energy supply source and a secondary energy supply source, and the controller may be structured to control a kinetic energy to be supplied from the secondary energy supply source in accordance with a difference between the target kinetic energy and a kinetic energy supplied from the primary energy supply source. The primary energy supply source supplies the kinetic energy by causing a combustion within the cylinder of the internal combustion engine. The controller may be structured to obtain a combustion energy generated by the combustion, which is supplied from the primary energy supply source based on the physical value representing a state of an air/fuel mixture within the cylinder of the internal combustion engine, and to estimate the kinetic energy to be supplied from the primary energy supply source based on the obtained combustion energy. The controller may further estimate the kinetic energy to be supplied from the primary energy source by subtracting an energy consumed by a mechanical loss owing to an operation of the internal combustion engine from the combustion energy.

In the system of the invention, a cylinder in the expansion stroke may be identified when the internal combustion engine is stopped based on a state of the internal combustion engine such that the combustion within each cylinder is caused one after another from the identified cylinder by the primary energy supply source. A cylinder in the expansion stroke may be identified when the internal combustion engine is stopped based on a state of the stopped internal combustion engine. Then fuel is injected into the identified cylinder in the expansion stroke, and the obtained value of the combustion energy is changed in consideration with the diffusion state of the air/fuel mixture from the fuel injection to a start of the combustion within the identified cylinder. An electric motor may be used as the secondary energy supply source.

A method of starting an internal combustion engine may include steps of injecting a fuel into a cylinder in an expansion stroke when the internal combustion engine is stopped such that the fuel is combusted within the cylinder to generate a combustion energy for starting the internal combustion engine, obtaining the combustion energy generated by combusting the fuel based on a state of an air/fuel mixture within the cylinder to which the fuel is injected, estimating a kinetic energy generated by the combustion and supplied to the internal combustion engine based on the obtained combustion energy, and supplying an energy from a predetermined starting energy supply source, the energy corresponding to a difference between a predetermined target kinetic energy required for starting the internal combustion engine after starting the combustion and the estimated kinetic energy.

A system of starting an internal combustion engine for injecting a fuel into a cylinder in an expansion stroke when the internal combustion engine is stopped using a combustion energy generated by combusting the fuel, which includes a controller that stores a target kinetic energy set as a kinetic energy required for starting the internal combustion engine, obtains the combustion energy generated by combusting the fuel based on a state of an air/fuel mixture within the cylinder to which the fuel is injected, estimates a kinetic energy generated by the combustion and supplied to the internal combustion engine based on the obtained combustion energy, and serves to supply an energy from a predetermined energy supply source, the energy corresponding to a difference between the stored target kinetic energy and the estimated kinetic energy.

According to the aforementioned forms, insufficiency of the kinetic energy generated by the combustion in the internal combustion engine with respect to the target kinetic energy may be compensated by the energy supplied from a secondary energy supply source such as the starter motor. As a result, appropriate amount of the kinetic energy is supplied to the internal combustion engine so as to be started. Moreover, the over-speed of the internal combustion engine upon its start is prevented so as to avoid various problems owing to the over-speed, for example, deterioration in the fuel efficiency, noise and the like.

A method of estimating an energy for starting an internal combustion engine in which a fuel is injected into a cylinder in an expansion stroke when the internal combustion engine is stopped, using a combustion energy generated by combusting the injected fuel includes steps of obtaining the combustion energy based on a physical value indicating a state of an air/fuel mixture in the cylinder of the internal combustion engine, estimating a kinetic energy generated by the combustion based on the obtained combustion energy, and determining a kinetic energy by obtaining a difference between a predetermined target kinetic energy required for starting the internal combustion engine and the estimated kinetic energy so as to be supplied from an energy supply source other than the combustion of the injected fuel within the cylinder to the internal combustion engine.

A system of estimating an energy for starting an internal combustion engine in which a fuel is injected into a cylinder in an expansion stroke when the internal combustion engine is stopped, using a combustion energy generated by combusting the injected fuel includes a controller that stores a target kinetic energy to be set as a kinetic energy required for starting the internal combustion engine, obtains the combustion energy generated by combusting the fuel based on a physical value indicating a state of an air/fuel mixture in the cylinder of the internal combustion engine, estimates a kinetic energy generated by the combustion based on the obtained combustion energy, and determines a kinetic energy by obtaining a difference between the stored target kinetic energy and the estimated kinetic energy so as to be supplied from an energy supply source other than the combustion of the injected fuel within the cylinder to the internal combustion engine.

The use of the estimation method and the estimation system makes it possible to obtain the difference between the starting kinetic energy generated by the combustion in the internal combustion engine and the target kinetic energy. Then, the insufficiency of the kinetic energy is compensated by the energy supplied by the secondary energy supply source such as the starter motor so as to realize the starting method and the starting system of the invention.

DETAILED DESCRIPTION OF PREFERRED EMBODIMENTS

Figure 1:
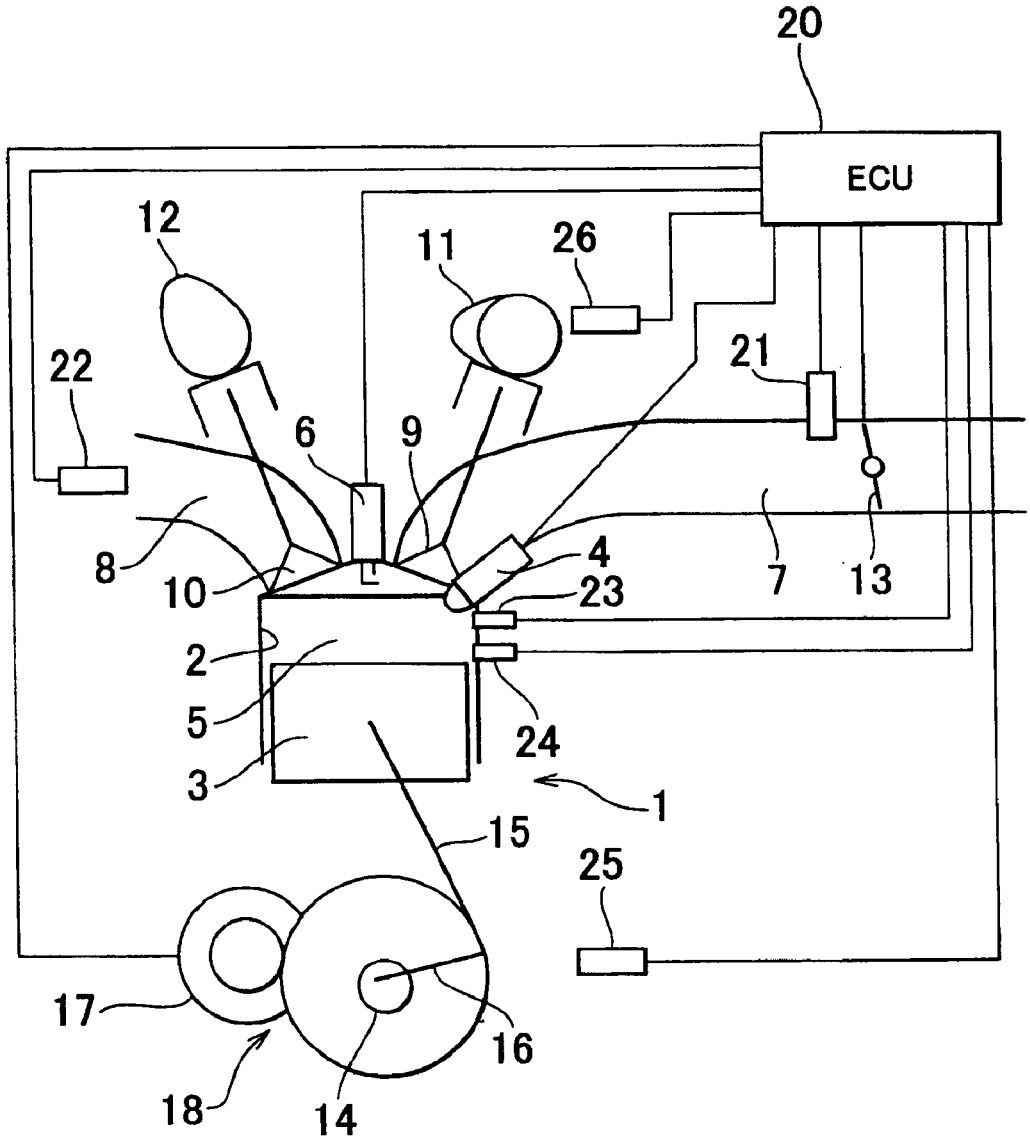
FIG. 1 is a schematic view of a starting system according to a first embodiment of the invention and an internal combustion engine to which the first embodiment is applied.

FIG. 1 is a schematic view of a starting system according to a first embodiment of the invention and an internal combustion engine on which the starting system is mounted. In FIG. 1, an internal combustion engine 1 is formed as a 4-cycle engine mounted on a vehicle, which is provided with a plurality of cylinders 2. Although FIG. 1 shows only one cylinder 2, each of the other cylinders 2 has the same structure as that shown in FIG. 1. The internal combustion engine 1 may be referred to as an engine 1 in the description below.

The phases of pistons 3 of the respective cylinders 2 are shifted one another in accordance with the number of the cylinders 2 and the arrangement thereof. In case of an in-line 4-cylinder engine, in which 4 cylinders 2 are aligned on one line, each phase of the pistons 3 is shifted at a crank angle of 180°. Therefore, one of 4 cylinders 2 is brought into the expansion stroke. The engine 1 is of direct injection type spark ignition internal combustion engine in which the fuel is directly injected from a fuel injection valve 4 into a combustion chamber 5 within the cylinder 2. The air/fuel mixture of the injected fuel is ignited by a spark plug 6. It is preferable to use gasoline as the fuel injected from the fuel injection valve 4. However, arbitrary type of the fuel may be used. The engine 1 is provided with an intake valve 9 and an exhaust valve 10 each serving to connect/disconnect the combustion chamber 5 to/from an intake passage 7 and an exhaust passage 8, respectively. The engine 1 is further provided with cams 11, 12 for driving the intake valve 9, exhaust valve 10, respectively, a throttle valve 13 for adjusting the quantity of the intake air from the intake passage 7, a connecting rod 15 and a crank arm 16 for transmitting the reciprocating movement of the piston 3 to a crankshaft 14 as a rotary motion. The aforementioned structure may be similar to that of an internal combustion engine of a general type.

Figure 2:
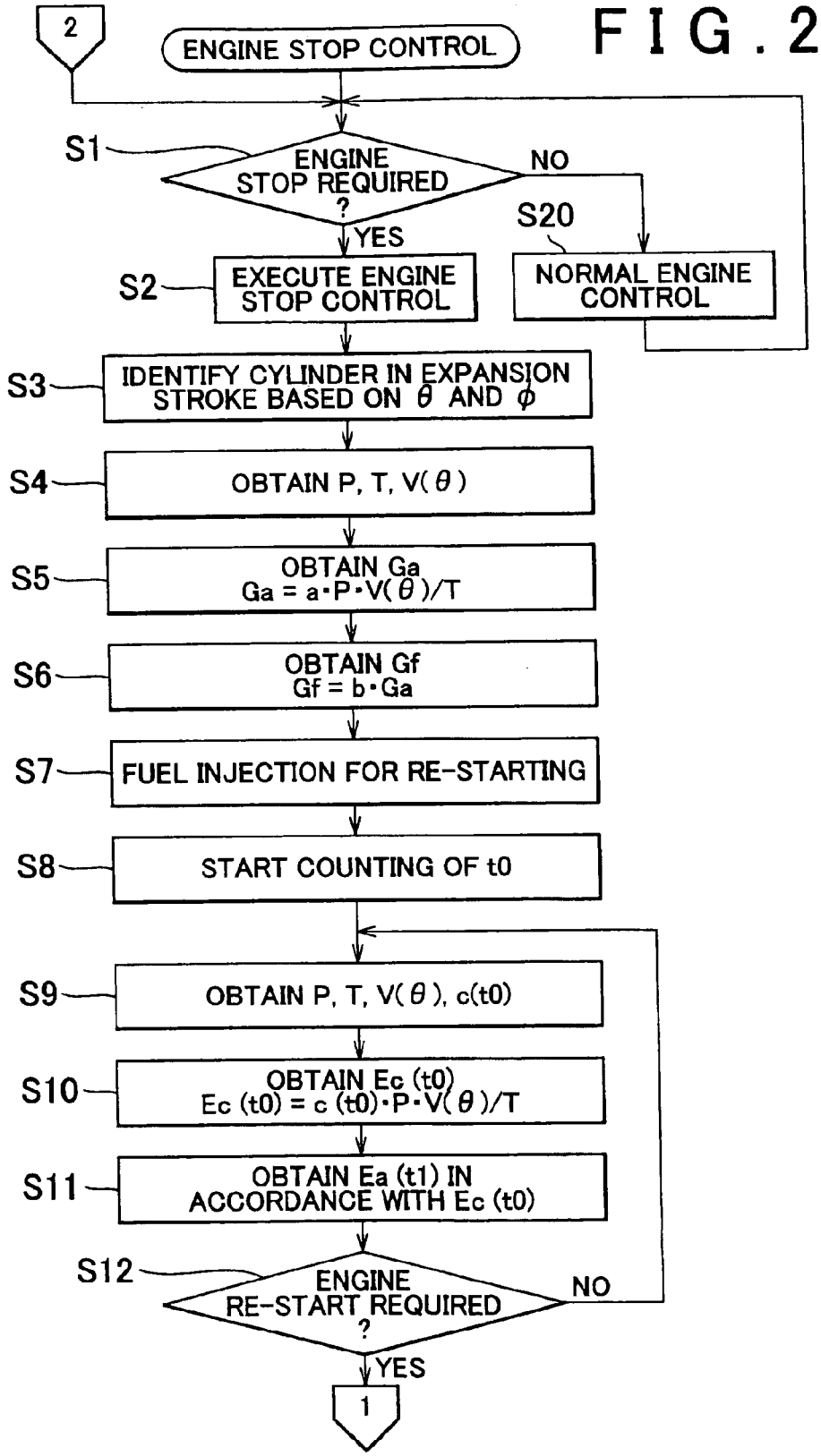
FIG. 2 is a flowchart representing a routine for controlling an operation for stopping the engine executed by ECU.
Figure 3:
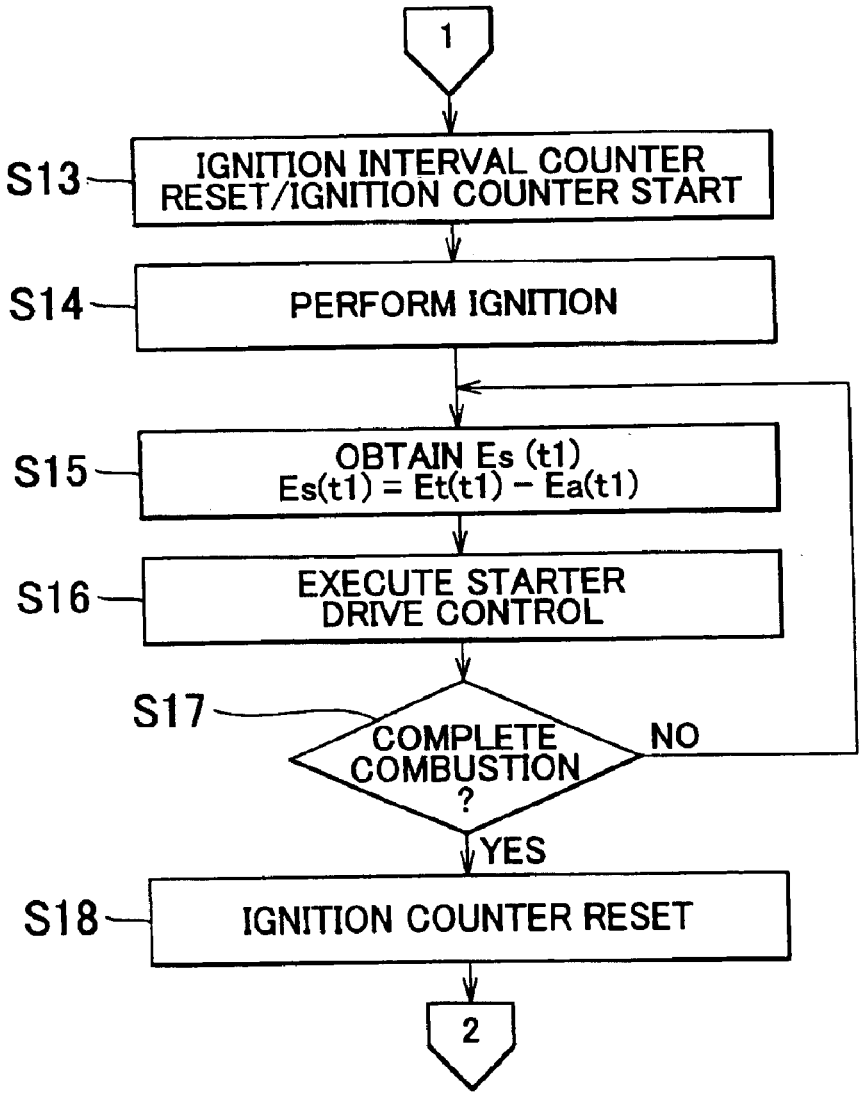
FIG. 3 is a flow chart continued from that shown in FIG. 2.

The engine 1 includes a starting energy supply source for starting the engine, which serves to cause combustion within the cylinder 2 such that the resultant kinetic energy is supplied to the engine 1 (primary energy supply source). The primary energy supply source causing the combustion within the cylinder is realized by an engine control unit or an electronic control unit (ECU) 20 that executes an engine stop control routine as shown by the flowcharts of FIGS. 2 and 3. The engine 1 is further provided with a secondary energy supply source in the form of a starter motor 17. The starter motor 17 is an electric motor that is driven to rotate the crankshaft 14 via a reducing gear mechanism 18. The electricity or voltage applied to the starter motor 17 is controlled such that the kinetic energy supplied to the engine 1 from the starter motor 17 is variable. For example, the electric motor may be PWM controlled such that the resultant kinetic energy is adjustable, which may be used as the starter motor 17.

The ECU 20 is formed as a computer including a microprocessor and peripheral devices required for driving the micro-processor such as RAM and ROM. The ECU 20 executes various kinds of processing for controlling operating states of the engine 1 in accordance with the program stored in the ROM. The ECU 20 controls quantity of the fuel injected from the fuel injection valve 4 such that a predetermined air/fuel ratio is obtained by referring to signals output from an intake air pressure sensor 21 corresponding to the pressure within the intake passage 7, an air/fuel ratio sensor 22 corresponding to an air/fuel ratio of the exhaust gas within the exhaust passage 8. The sensors other than those 21, 22 may be provided for outputting signals to be referred by the ECU 20. Especially, provided relative to the processing shown in FIGS. 2 and 3 are a pressure sensor 23 that outputs signals corresponding to the pressure within the combustion chamber 5, a temperature sensor 24 that outputs signals corresponding to the temperature of the combustion chamber 5, a crank angle sensor 25 that outputs signals corresponding to the phase (crank angle) of the crankshaft 14, and a cam angle sensor 26 that outputs signals corresponding to the phase (cam angle) of the cam 11 at the intake side.

The engine stop control routine as shown by the flowcharts of FIGS. 2 and 3 will be described. Upon execution of the control routine by the ECU 20, when a predetermined condition for stopping the engine 1 is established, the combustion of the engine 1 is temporarily stopped. Then when a predetermined condition for re-starting the engine 1 is established, the engine 1 is re-started. The engine stop control routine as shown by the flowcharts of FIGS. 2 and 3 will be executed accompanied with the other processing executed by the ECU 20. The success or failure in the establishment of the conditions for stopping and re-starting the engine 1 is monitored by the routine other than those shown in FIGS. 2 and 3. In case of the success in the establishment of the condition for stopping the engine, a predetermined engine stop request is issued. In case of the success in the establishment of the conditions for re-starting the engine 1, a predetermined engine re-start request is issued. The engine stop condition is established when the engine 1 is in an idling state. The engine re-start condition is established when the engine 1 is driven from the idling state for a certain operation related to starting, for example, depression of the accelerator pedal or the clutch pedal, operation of the shift device, and the like. The engine stop control routine shown in FIGS. 2 and 3 is used for realizing an idling stop such that the engine 1 is stopped when the vehicle is stopped, and the engine 1 is re-started before the vehicle starts.

Referring to the flowchart of the engine stop control routine shown in FIG. 2, first in step S1, it is determined whether a request for stopping the engine 1 has been issued. If No is obtained in step S1, the process proceeds to step S20 where a normal control of the engine 1 is ordered and returns to step S1. If Yes is obtained in step S1, that is, the engine stop request has been issued, the process proceeds to step S2 where the engine stop control is executed. Upon stop of the engine 1, the process proceeds to step S3 where a crank angle θ and a cam angle ϕ at the intake side are detected on the basis of signals from the crank angle sensor 25 and the cam angle sensor 26, respectively. Then the cylinder 2 in the expansion stroke is identified based on the detected results.

In step S4, a pressure P and a temperature T in the combustion chamber 5 are obtained on the basis of signals from the pressure sensor 23 and the temperature sensor 24, respectively. A capacity V(θ) of the combustion chamber 5 is obtained on the basis of the crank angle θ. The capacity of the combustion chamber 5 is defined by a position of the piston 3, a diameter of the cylinder 2, a shape of the top surface of the piston 3, and the like. The aforementioned values except the position of the piston 3 are constant irrespective of the crank angle θ. The position of the piston 3 is defined only by the crank angle θ. Accordingly the capacity V(θ) of the combustion chamber 5 can be obtained by substituting the crank angle θ derived from the output signal of the crank angle sensor 25 in a function using the crank angle θ as a variable.

In step S5, quantity of intake air Ga into the cylinder 2 in the expansion stroke is calculated using the equation (1) as follows.

Equation (1)

$$Ga=a\cdot P\cdot V(\theta)/T \tag{1}$$

where a represents a coefficient, P and T represent the pressure and the temperature of the combustion chamber, respectively.

In step S6, quantity of injected fuel Gf (=b·Ga) for re-starting the engine 1 is obtained by multiplying the intake air amount Ga by a predetermined coefficient b. Then in step S7, the obtained quantity Gf of the fuel is injected into the cylinder in the expansion stroke that has been identified in step S3 as the fuel for re-starting the engine 1. In step S8, the counter for counting the ignition interval t0 is started. The coefficient b used in step S6 is set on the basis of the target value of the air/fuel ratio upon start of the engine.

In step S9, the pressure P and the temperature T in the combustion chamber are obtained on the basis of the signals from the pressure sensor 23 and the temperature sensor 24, and the capacity V(θ) of the combustion chamber is obtained on the basis of the signal from the crank angle sensor 25. The aforementioned values are physical values representing the state of the air/fuel mixture within the combustion chamber 5.

Figure 4:
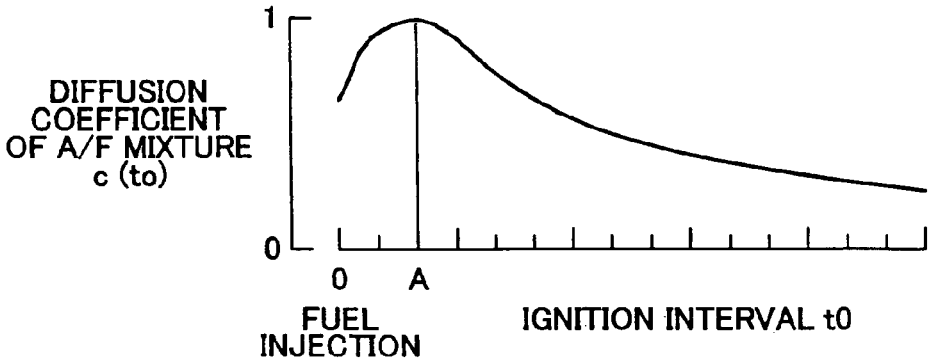
FIG. 4 is a graph representing a diffusion coefficient of the air/fuel mixture referred by the ECU for executing the control routine shown by the flowchart of FIG. 2.

In step S9, a diffusion coefficient c (t0) of the air/fuel ratio is obtained on the basis of the count value of the ignition interval t0. As shown in FIG. 4, the diffusion coefficient c (t0) of the air/fuel mixture is obtained by the function using the ignition interval t0 as the variable. The diffusion coefficient c takes a peak value 1 upon passage of a predetermined time A from the timing of fuel injection (t0=0). Thereafter, the value of the diffusion coefficient gradually decreases from 1 to 0. As the air/fuel mixture gradually diffuses to the outside of the combustion chamber 5 as a passage of time, the combustion energy (energy generated by the combustion) is decreased accordingly. The diffusion coefficient c (t0) serves to reflect the decrease in the combustion energy in an operation for obtaining the combustion energy. The diffusion coefficient c (t0) increases until passage of the predetermined time A because of a constant delay of time taken from vaporization of the injected fuel to formation of the air/fuel mixture. The predetermined time A, however, takes only several tens milliseconds, and the value within 1 second at the maximum.

The relationship between the ignition interval t0 and the diffusion coefficient c (t0) is preliminarily obtained by simulation or experiments, which may be stored as a map or a function in the ROM of the ECU 20. In step S9, the diffusion coefficient c (t0) corresponding to the ignition interval t0 is obtained by referring to the map stored in the ROM.

Next in step S10, the combustion energy Ec (t0) generated by combustion of the fuel injected in step S7 is obtained using the equation (2) as follows.

Equation (2)

$$Ec(t0)=c(t0)\cdot P\cdot V(\theta)/T \tag{2}$$

Then in step S11, the kinetic energy Ea (t1) supplied to the crankshaft 14 is estimated on the basis of the combustion energy Ec (t0) obtained in step S10. The specific method for estimating the kinetic energy Ea (t1) will be described later. The time t1 represents the passage of time from the ignition, and the kinetic energy Ea (t1) is expressed as a function of passage of time from the ignition. After estimating the kinetic energy Ea (t1), the process proceeds to step S12 where it is determined whether the request for re-starting the engine 1 has been issued. If No is obtained in step S12, that is, no request for re-starting the engine 1 has been issued, the process returns to step S9 from where the process is executed in the subsequent steps, that is, the state of the air/fuel mixture is determined in step S9, the combustion energy Ec (t0) is obtained in step S10 on the basis of the result determined in step S9, and the kinetic energy Ea (t1) is estimated in step S11.

The method of estimating the kinetic energy Ea (t1) will be described hereinafter. Assuming that the combustion energy that is generated within an arbitrary period is designated as Ec, and the kinetic energy resulting from rotary motion of the crankshaft 14 is designated as Ea, the following relationship may be expressed by the equation (3).

Equation (3)

$$Ec=Ef+Ea \quad (3)$$

where Ef represents the mechanical loss owing to an operation of the engine 1, for example, the energy consumption by the mechanical loss owing to the friction. This may be identified as the function of the rotational speed Ne of the crankshaft 14. The relationship between the rotational speed Ne and the energy loss Ef is preliminarily obtained by simulation or experiments. The relationship between the combustion energy Ec and the behavior of the crankshaft 14 in accordance therewith may be defined by the simulation. If the behavior of the crankshaft 14 is defined, it is possible to define the relationship between the combustion energy Ec and the rotational speed Ne of the crankshaft 14. Accordingly if the combustion energy Ec (t0) upon the ignition is obtained, the corresponding energy loss Ef may be defined. This makes it possible to obtain the kinetic energy Ea supplied to the crankshaft 14 by subtracting the defined energy loss Ef from the combustion energy Ec (t0) obtained by the initial combustion.

Upon start of the internal combustion engine 1, combustion in each of the respective cylinders 2 is sequentially generated in order of ignition. The energy generated in the second and subsequent combustion in the cylinders 2 may be obtained in the same manner as described above. That is, each combustion energy Ec generated in the respective cylinders 2 is defined by the physical values P, V(θ), and T indicating the state of the air/fuel mixture in the respective cylinders 2. In this case, however, as the combustion is generated sequentially in the respective cylinders 2, the diffusion coefficient of the air/fuel mixture does not have to be considered. This makes it possible to obtain the kinetic energy Ea of the crankshaft 14 corresponding to the combustion energy Ec obtained by each combustion in the respective cylinders. The thus obtained kinetic energy Ea is summed in correlation with the time passage t1 from the ignition so as to obtain the kinetic energy Ea of the crankshaft 14 generated by the combustion of the engine 1 as the function Ea (t1) correlated with the time passage t1.

Figure 5:
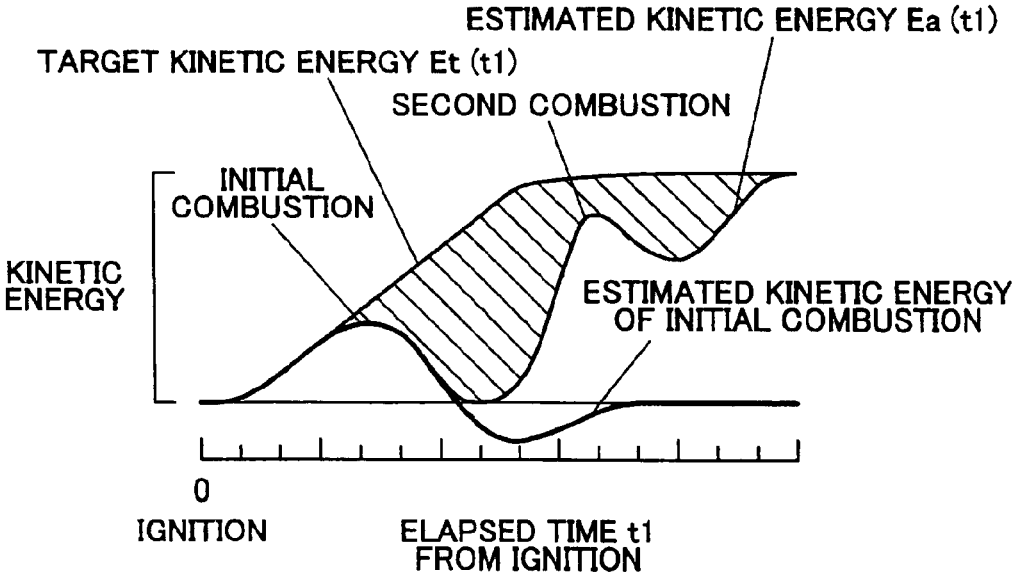
FIG. 5 is a graph representing a relationship between the target kinetic energy and the estimated value of the kinetic energy.

FIG. 5 shows an example of estimating the kinetic energy Ea (t1) in accordance with the aforementioned method. The bold curve of the graph corresponds to the estimated values of the kinetic energy on the basis of the initial combustion energy Ec (t0). As clearly indicated by this graph, the combustion energy is added at every generation of the combustion in the respective cylinders 2 such that the estimated value Ea (t1) of the kinetic energy increases. However, the kinetic energy Ea (t1) decreases during the combustion owing to the mechanical loss. Meanwhile, in order to smoothly start the engine 1, the target kinetic energy Et (t1) has to be set so as to sequentially increase the kinetic energy from the ignition until it reaches an equilibrium state at a predetermined level. The target kinetic energy Et (t1) is defined by the mechanical characteristics of the engine 1, which is preliminarily obtained by the simulation or experiments. Generally the estimated value Ea (t1) of the kinetic energy is relatively smaller than the target kinetic energy Et (t1) owing to the mechanical loss. Accordingly in the case where the combustion in the engine 1 is only used for the start-up, the kinetic energy may be insufficient by the amount corresponding to the hatched area shown in FIG. 5.

In the engine stop control routine shown in FIGS. 2 and 3, the energy corresponding to the hatched area as shown in FIG. 5 is compensated by the energy supplied from the starter motor 17 so as to obtain the target kinetic energy Et (t1).

Referring to the flowchart of FIG. 2, if Yes is obtained in step S12, that is, the re-start of the engine has been required, the process further proceeds to step S13 in the flowchart of FIG. 3 where the ignition interval counter is reset and the ignition counter starts counting the time passage t1. The ignition is performed in the cylinder 2 in the expansion stroke in step S14. Then in step S15, the start assist energy Es (t1) is calculated using the equation (4) in accordance with the time passage t1 of the ignition counter.

Equation (4)

$$Es(t1)=Et(t1)-Ea(t1) \quad (4)$$

The insufficient amount of the kinetic energy that cannot be covered by the kinetic energy Ea (t1) with respect to the target kinetic energy Et (t1) at the time passage t1 is obtained as the start assist energy Es (t1). The target kinetic energy Et (t1) is preliminarily stored in the ROM of the ECU 20, which is referred in time of necessity.

In step S16, the starter motor 17 is driven such that the start assist energy Es (t1) is supplied to the crankshaft 14. In step S17, it is determined whether the complete combustion where the combustion of the engine 1 is continuously performed is obtained. If No is obtained in step S17, the process returns to step S15 where the control routine is executed repeatedly. The determination with respect to the complete combustion in step S17 may be made on the basis of variation in the crank angle detected by the crank angle sensor 25, for example. If Yes is obtained in step S17, that is, the complete combustion is obtained, the process proceeds to step S18 where the ignition counter is reset, and the process returns to step S1.

In the embodiment, the energy required for starting the engine 1 is preliminarily set as the target kinetic energy Et (t1). The difference between the target kinetic energy Et (t1) and the kinetic energy Ea (t1) generated by combustion is obtained as the start assist energy Es (t1). The start assist energy Es (t1) is supplied from the starter motor 17 to the engine 1. Therefore, the target kinetic energy Et (t1) is supplied to the engine 1 so as to be smoothly started while saving the energy.

In the embodiment, the target kinetic energy Et (t1) is preliminarily obtained, and a range of the kinetic energy generated by the combustion is also estimated. This makes it possible to obtain the energy to be supplied to the engine 1 from the starter motor 17 to a certain degree. This eliminates the need of mounting unnecessarily large starter motor, releasing the limitation of mounting the starter motor as well as reducing the cost thereof. In the conventional system, the energy required for starting the engine cannot be obtained in advance, and the insufficient energy is compensated by the starter motor after identifying the insufficiency in the energy. That is, the conventional technology fails to obtain the energy for compensating the insufficient energy in advance. Therefore, the size of the starter has to be larger to supply more energy just in case for unexpected circumstances. On the contrary, in the embodiment, an appropriate size of the starter motor 17 can be set, thus reducing size and weight thereof.

In the embodiment, the ECU 20 serves to control energy, obtain the combustion energy, estimate the kinetic energy, and identify the cylinder in the expansion stroke. The ECU 20 further serves to cause the fuel injection valve 4 corresponding to the cylinder 2 in the expansion stroke to inject the fuel. The ROM of the ECU 20 serves to store the target kinetic energy.

The target kinetic energy may be set from various aspects. The target kinetic energy may be set as a theoretical minimum kinetic energy for obtaining the complete combustion state of the engine 1, for example. In this case, the energy consumption upon start of the engine may be minimized. Therefore, it is preferable for the case of executing the idling stop control where the operation of the engine 1 to be stopped or re-started is frequently repeated.

The start of the engine according to the invention is not limited to the re-start of the engine upon idling stop state. The invention may be applied to the start of the engine corresponding to ON operation of the ignition key, for example. If the target kinetic energy is set to the theoretical minimum value, the noise or vibration caused by the start of the engine may become so small that the occupant of the vehicle does not notice the start of the engine, and may misunderstand that the start of the engine has failed. In order to avoid the aforementioned misunderstanding, the target kinetic energy may be larger than the theoretical minimum value so as to make sure that the occupant feels the start of the engine 1.

Alternatively the invention may be applied to various cases of starting the internal combustion engine, for example, re-start of the engine of the hybrid vehicle including the internal combustion engine and the electric motor.

In the embodiment, the secondary energy supply source is formed as the electric motor. However, various types of devices may be used as the secondary energy supply source. For example, the internal combustion engine to be started may be provided with another internal combustion engine. Alternatively the secondary energy supply source may be formed as the device that stores the energy under the pressure of the fluid such as the air pressure and releases the stored energy upon start of the engine.

In the embodiment, the pressure P and the temperature T of the combustion chamber are directly detected by the sensors 23, 24, respectively as the physical values indicating the state of the air/fuel mixture within the combustion chamber. However, the physical values correlated with the pressure and the temperature of the combustion chamber, for example, temperature of the engine cooling water, the time passage from the stop of the engine, may be detected such that the state of the air/fuel mixture is determined using the map or the function.

In the aforementioned embodiment, the primary energy supply source is structured to generate combustion within the cylinder 2 of the engine 1 so as to supply the kinetic energy. The primary energy supply source, however, may be formed as the device having the other structure. It is assumed, in the aforementioned embodiment, that the kinetic energy supplied from the primary energy supply source is not sufficient for the target kinetic energy. However, the embodiment may be structured to supply negative kinetic energy (apply resistance to the rotary motion of the crankshaft) from the secondary energy supply source in the case where the kinetic energy supplied from the primary energy supply source exceeds the target kinetic energy such that the total energy supplied from the primary and the secondary energy supply sources becomes equal to the target kinetic energy.

The number of the energy supply source may be arbitrarily set so long as the total energy supplied from the energy supply sources becomes equal to the predetermined target kinetic energy.

According to the method and system of starting the internal combustion engine, the target kinetic energy is preliminarily set, and the supplied energy is controlled to become equal to the target kinetic energy. This makes it possible to supply appropriate amount of the kinetic energy to the internal combustion engine upon its start. As a result, the internal combustion engine is reliably started while preventing over-speed upon the start of the engine and avoiding various problems owing to the over-speed, for example, deterioration in the fuel efficiency and noise.

What is claimed is:

1. A method of starting an internal combustion engine comprising:

setting a target kinetic energy as being a kinetic energy required for starting the internal combustion engine; and supplying a starting energy controlled in accordance with the target kinetic energy to the internal combustion engine from a predetermined starting energy supply source, wherein the starting energy supply source includes a primary energy supply source and a secondary energy supply source, a difference between the target kinetic energy and a kinetic energy supplied from the primary energy supply source is obtained, and a kinetic energy corresponding to the obtained difference is further supplied from the secondary energy supply source.

2. The method according to claim 1, wherein the primary energy supply source supplies the kinetic energy generated by a combustion within a cylinder of the internal combustion engine.

3. The method according to claim 2, wherein a combustion energy generated by the combustion within the cylinder is obtained based on a physical value representing a state of an air/fuel mixture within the cylinder of the internal combustion engine, and the kinetic energy to be supplied from the primary energy supply source is estimated based on the obtained combustion energy.

4. The method according to claim 3, wherein the kinetic energy to be supplied from the primary energy supply source is estimated by subtracting an energy consumed by a mechanical loss owing to an operation of the internal combustion engine from the combustion energy.

5. The method according to claim 2, wherein a cylinder in an expansion stroke is identified when the internal combustion engine is stopped based on a state of the internal combustion engine that is stopped, and the combustion is started within each cylinder of the internal combustion engine one after another from the identified cylinder.

6. The method according to claim 3, wherein a cylinder in an expansion stroke is identified when the internal combustion engine is stopped based on a state of the stopped internal combustion engine, a fuel is injected into the identified cylinder during a period when the internal combustion engine is stopped, and a value of the obtained combustion energy is changed in consideration with a diffusion state of the air/fuel mixture from the injection of the fuel to a start of the combustion within the identified cylinder.

7. The method according to claim 1, wherein the secondary energy supply source comprises an electric motor.

8. A system for starting an internal combustion engine comprising:

a starting energy supply source that supplies a kinetic energy required for starting the internal combustion engine; and a controller that controls the kinetic energy to be supplied to the internal combustion engine from the starting energy supply source in accordance with a predetermined target kinetic energy required for starting the internal combustion engine, wherein the starting energy supply source comprises a primary energy supply source and a secondary energy supply source, and the controller controls a kinetic energy to be supplied from the secondary energy supply source in accordance with a difference between the target kinetic energy and a kinetic energy supplied from the primary energy supply source.

9. The system according to claim 8, wherein the primary energy supply source supplies the kinetic energy by causing a combustion within the cylinder of the internal combustion engine.

10. The system according to claim 9, wherein the controller obtains a combustion energy generated by the combustion, which is supplied from the primary energy supply source based on the physical value representing a state of an air/fuel mixture within the cylinder of the internal combustion engine, and estimates the kinetic energy to be supplied from the primary energy supply source based on the obtained combustion energy.

11. The system according to claim 10, wherein the controller estimates the kinetic energy to be supplied from the primary energy source by subtracting an energy consumed by a mechanical loss owing to an operation of the internal combustion engine from the combustion energy.

12. The system according to claim 9, wherein a cylinder in the expansion stroke is identified when the internal combustion engine is stopped based on a state of the internal combustion engine such that the combustion within each cylinder is caused one after another from the identified cylinder by the primary energy supply source.

13. The system according to claim 10, wherein a cylinder in the expansion stroke is identified when the internal combustion engine is stopped based on a state of the stopped internal combustion engine, a fuel is injected into the identified cylinder in the expansion stroke, and the obtained value of the combustion energy is changed in consideration with the diffusion state of the air/fuel mixture from the fuel injection to a start of the combustion within the identified cylinder.

14. The system according to claim 8, wherein the secondary energy supply source comprises an electric motor.

15. A method of starting an internal combustion engine comprising:

injecting a fuel into a cylinder in an expansion stroke when the internal combustion engine is stopped such that the fuel is combusted within the cylinder to generate a combustion energy for starting the internal combustion engine;

obtaining the combustion energy generated by combusting the fuel based on a state of an air/fuel mixture within the cylinder to which the fuel is injected;

estimating a kinetic energy generated by the combustion and supplied to the internal combustion engine based on the obtained combustion energy; and supplying an energy from a predetermined starting energy supply source, the energy corresponding to a difference between a predetermined target kinetic energy required for starting the internal combustion engine after starting the combustion and the estimated kinetic energy.

16. A system of starting an internal combustion engine for injecting a fuel into a cylinder in an expansion stroke when the internal combustion engine is stopped using a combustion energy generated by combusting the fuel, the system comprising a controller that:

stores a target kinetic energy set as a kinetic energy required for starting the internal combustion engine;

obtains the combustion energy generated by combusting the fuel based on a state of an air/fuel mixture within the cylinder to which the fuel is injected;

estimates a kinetic energy generated by the combustion and supplied to the internal combustion engine based on the obtained combustion energy; and serves to supply an energy from a predetermined energy supply source, the energy corresponding to a difference between the stored target kinetic energy and the estimated kinetic energy.

17. A method of estimating an energy for starting an internal combustion engine in which a fuel is injected into a cylinder in an expansion stroke when the internal combustion engine is stopped, using a combustion energy generated by combusting the injected fuel, the method comprising:

obtaining the combustion energy based on a physical value indicating a state of an air/fuel mixture in the cylinder of the internal combustion engine;

estimating a kinetic energy generated by the combustion based on the obtained combustion energy; and determining a kinetic energy by obtaining a difference between a predetermined target kinetic energy required for starting the internal combustion engine and the estimated kinetic energy so as to be supplied from an energy supply source other than the combustion of the injected fuel within the cylinder to the internal combustion engine.

18. A system of estimating an energy for starting an internal combustion engine in which a fuel is injected into a cylinder in an expansion stroke when the internal combustion engine is stopped, using a combustion energy generated by combusting the injected fuel; the system comprising a controller that:

stores a target kinetic energy to be set as a kinetic energy required for starting the internal combustion engine;

obtains the combustion energy generated by combusting the fuel based on a physical value indicating a state of an air/fuel mixture in the cylinder of the internal combustion engine;

estimates a kinetic energy generated by the combustion based on the obtained combustion energy; and determines a kinetic energy by obtaining a difference between the stored target kinetic energy and the estimated kinetic energy so as to be supplied from an energy supply source other than the combustion of the injected fuel within the cylinder to the internal combustion engine.

* * * * *